US006779199B1

(12) United States Patent
O'Dea et al.

(10) Patent No.: US 6,779,199 B1
(45) Date of Patent: Aug. 24, 2004

(54) MAGNETIC WORK GLOVE

(75) Inventors: Thomas J. O'Dea, Sioux Falls, SD (US); Thomas S. Jellema, Sioux Falls, SD (US)

(73) Assignee: Handyglove, LLC, Sioux Falls, SD (US)

( * ) Notice: Subject to any disclaimer, the term of this patent is extended or adjusted under 35 U.S.C. 154(b) by 0 days.

(21) Appl. No.: 10/642,972

(22) Filed: Aug. 18, 2003

Related U.S. Application Data

(63) Continuation-in-part of application No. 10/122,446, filed on Apr. 13, 2002, now Pat. No. 6,643,845.
(60) Provisional application No. 60/284,386, filed on Apr. 16, 2001.

(51) Int. Cl.[7] ..... A41D 19/00
(52) U.S. Cl. ..... 2/161.6; 2/160; 224/183
(58) Field of Search ..... 2/160, 167, 161.6, 2/16, 20, 21, 161.1, 163, 161.8, 910, 917; 206/818; 224/183, 218, 901.8; 600/9, 15

(56) References Cited

U.S. PATENT DOCUMENTS

| | | | | |
|---|---|---|---|---|
| 1,174,887 A | | 3/1916 | Meriwether | |
| 3,636,568 A | | 1/1972 | Stuner | |
| 4,325,504 A | | 4/1982 | Amani | |
| 5,593,073 A | | 1/1997 | Finnegan | |
| 5,715,539 A | | 2/1998 | Benecki et al. | |
| 5,795,248 A | * | 8/1998 | Giglio | 473/406 |
| 6,014,775 A | * | 1/2000 | Missry | 2/161.2 |
| 6,119,271 A | * | 9/2000 | Byon | 2/161.2 |

FOREIGN PATENT DOCUMENTS

| | | | | |
|---|---|---|---|---|
| GB | 2168898 | * | 7/1986 | A61N/1/42 |

* cited by examiner

*Primary Examiner*—Gary L. Welch
(74) *Attorney, Agent, or Firm*—Gold & Rizvi, P. A.; Glenn E. Gold; H. John Rizvi

(57) ABSTRACT

A work glove is provided having a flexible magnetic enclosure disposed on the rear surface of a glove body. A plurality of magnets contained within the enclosure are provided for attracting and retaining work components against an exterior surface of the enclosure of the glove for convenient access during a construction or assembly operation. A flexible magnet insulating substrate is provided for insulating adjacent magnets from one another as well as maintaining the magnets in a fixed spaced-apart relationship within the enclosure.

9 Claims, 9 Drawing Sheets

MAGNETIC WORK GLOVE

CROSS REFERENCE TO RELATED APPLICATIONS

This application is a continuation-in-part of patent application Ser. No. 10/122,446, filed on Apr. 13, 2002, now U.S. Pat. No. 6,643,845 which relates to the same subject matter as provisional patent application Serial No. 60/284,386, filed by the same inventors on Apr. 16, 2001. This application claims the Apr. 13, 2002 and Apr. 16, 2001 filing dates as to the respective common subject matter.

BACKGROUND OF THE INVENTION

1. Field of the Invention

The present invention relates generally to gloves, and more particularly to a work glove having means for magnetically attracting and retaining work components against an outer surface of the glove for easy access during an assembly, construction or other operation.

2. Description of the Prior Art

The difficulties associated with the handling of small metal components during various construction and assembly-related operations are well known. In particular, the need to use both hands simultaneously during such operations makes it difficult for workmen to hold even a small quantity of components in-hand for easy access. For example, driving a nail into a work piece initially requires two hands to start the nail into the work piece. Similarly, many assembly operations, such as the attachment of a threaded fastener to a work piece or to another threaded component, require the simultaneous use of both hands. The difficulties associated with handling components during such operations is further compounded when a worker is required to wear gloves for hand protection, since the gloves tend to interfere with the ability to grip and manipulate the components. For the aforementioned reasons, workmen commonly maintain or store components in a container, apron pouch or other component holder, drawing one component at a time. The inefficiencies concomitant with continuously reaching into a component holder during the performance of a repetitive operation can add significantly to the time necessary to complete the corresponding manufacturing or construction task.

Accordingly, it would be desirable to provide a means for maintaining an excess quantity of components proximate to the hands of a worker in a manner enabling the worker to access the components in an expeditious and efficient manner.

SUMMARY OF THE INVENTION

The present invention provides a work glove having an enclosure disposed along the back surface of a glove body. A magnetic assembly contained within the enclosure creates a magnetic field acting to attract and retain work components against the outer surface of the enclosure.

In one aspect of the present invention, the magnetic assembly is comprised of a plurality of magnets disposed in spaced-apart relationship within apertures of a resilient, or flexible, magnetically insulating member; and a strip of adhesive material wrapped around the magnet-containing resilient member. The magnetic assembly is disposed directly against the back surface of the glove body. A resilient, or flexible, article of material having a periphery fixedly attached to the back surface of the glove body defines a magnetic assembly-containing enclosure adjacent to the knuckle portion of the glove body.

In another aspect of the present invention, the flexible magnetically insulating member incorporates magnet-receiving cavities in lieu of apertures.

In still another aspect of the present invention, the flexible magnetically insulating member incorporates magnet-receiving apertures each having a recessed channel provided in the aperture sidewall. The recessed channels are sized and shaped for snap-fit engagement with the peripheries of the magnets.

In yet another aspect of the present invention, the magnets are provided completely encapsulated within the flexible member.

In a further aspect of the present invention, the magnetic assembly containing enclosure is configured for releasable attachment to the back surface of the glove body. In this aspect of the invention, the enclosure is preferably comprised of upper and lower enclosure layers fixedly secured to one another completely about their peripheries. Corresponding portions of a fastening system, such as a hook-and-loop fastener system, mechanical snap system and the like, are provided on the exterior surface of the lower enclosure layer and the back surface of the glove body.

In still yet another aspect of the invention, means are provided for selectively accessing an interior space of the enclosure, such that the magnetic assembly, or portions thereof, can be manipulated, replaced, etc.

In yet a further aspect of the present invention, additional magnets are provided within fingertip portions of the glove to facilitate gripping of components during a construction or assembly operation.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which:

FIGS. 4–7 are full section views taken through enclosure 20, illustrating various embodiments of resilient magnet-retaining member 32, wherein:

FIG. 4 illustrates the incorporation of magnet-retaining apertures 40 extending completely through resilient member 32;

FIG. 5 illustrates the incorporation of magnet-retaining cavities 42 provided in the upper surface of resilient member 32;

FIG. 6 illustrates the incorporation of magnet-retaining apertures 44 having recessed portions, or grooves 46, extending about the aperture sidewalls for providing snap-fit type engagement with the peripheries of the magnets 36;

FIG. 7 illustrates the incorporation of a resilient member 32 having magnets 36 complete encapsulated therein;

DETAILED DESCRIPTION OF THE PREFERRED EMBODIMENTS

Shown throughout the figures, the present invention is generally directed to a glove for use during a construction or assembly operation, wherein the glove incorporates means for magnetically attracting and retaining work components against a glove back surface. In the following written description and the accompanying drawing figures, the various embodiments of the invention are described and illustrated with respect to a left-handed glove merely for convenience. It is to be understood that the present invention is equally applicable to both left- and right-handed gloves.

Figure 1:
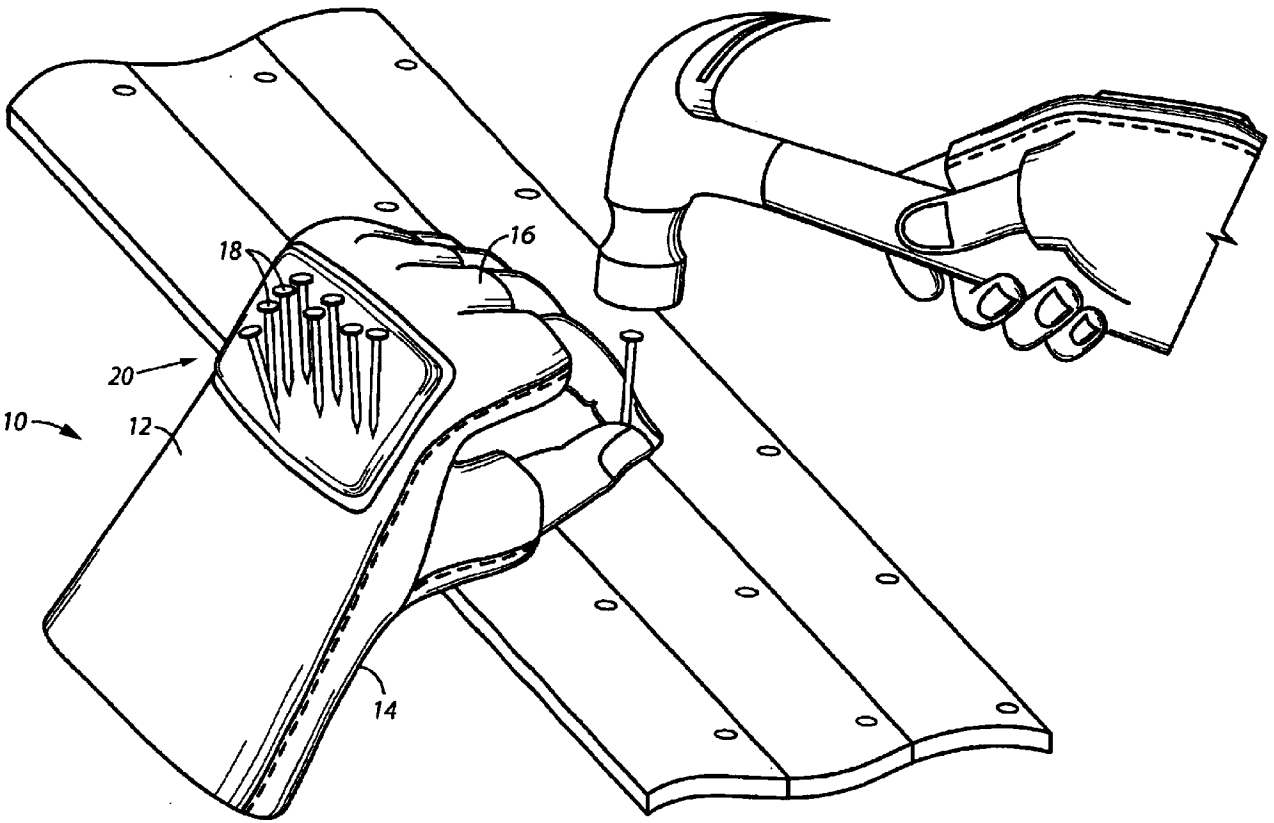
FIG. 1 is a perspective view illustrating the application of the magnetized work glove 10 of the present invention during a typical construction operation.

Referring initially to FIG. 1, the present invention is generally directed to a glove 10 having a magnetized enclosure, shown generally as reference numeral 20, for attracting and retaining components 18 against the enclosure exterior for easy access by a worker during a construction or assembly operation. The glove 10 is preferably of the flexible type commonly employed for industrial purposes such as construction and manufacturing. As described in detail below, a significant feature of the glove 10 is that it incorporates a magnetized enclosure 20 having a flexible construction particularly adapted to conform to the curvature of the back surface of a wearer's hand while gripping a tool, work piece or the like, thereby enhancing the overall comfort of the glove, especially when worn for an extended period of time.

The body of the glove can be constructed from any of various kinds and types of materials commonly used by glove manufacturers, including, but not limited to leather, cotton, cotton/polyester blends, vinyl, knits, rubber, rubber-coated knits and the like. The glove 10 has a back surface 12 and a front surface 14. Finger-receiving portions 16 extend distally from the glove body in the usual manner. Preferably, the finger-receiving portions are shortened and open-ended to expose the wearer's fingers and thumb. In this manner the glove wearer is better able to grip and manipulate components and tools. Magnetized enclosure 20 acts to attract and maintain ferrous-containing components 18, such as nails, screws, bolts, nuts and the like, against its generally planar outer surface for easy access during a repetitive construction or assembly operation.

Figure 2:
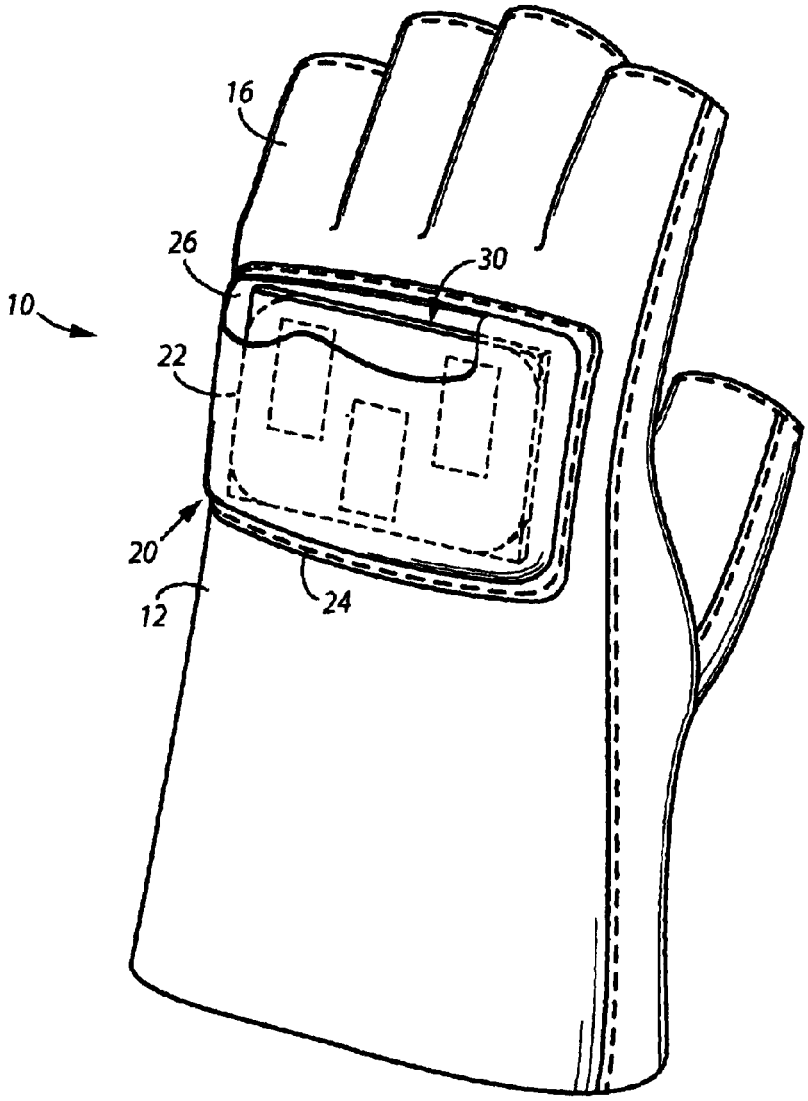
FIG. 2 is a partially-cutaway perspective view of the magnetic assembly enclosure 20 of the work glove of the present invention.
Figure 3:
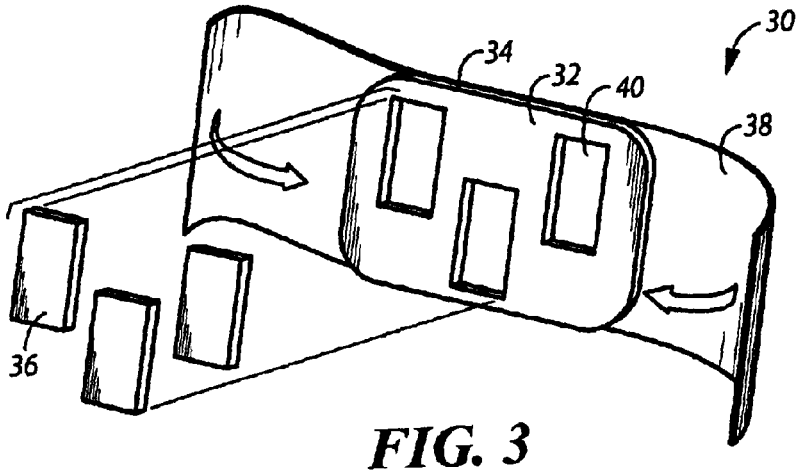
FIG. 3 is an exploded perspective view of the magnetic assembly 30.

Referring now to FIGS. 2–3, in one aspect of the present invention, magnetized enclosure 20 is constructed by stitching 24 or otherwise fixedly securing the periphery of a flexible article 22 to glove back surface 12 to define an enclosure interior space 26. Preferably, flexible article 22 is constructed from a resilient rubber material. A magnetic assembly 30 disposed directly against glove back surface 12 within enclosure 20 provides the desired magnetic field above flexible article 22.

As best shown in FIG. 3, magnetic assembly 30 is generally comprised of a plurality of magnets 36 retained within magnet-receiving portions 40 of a unitary flexible magnetically insulating planar substrate 32. By way of example, insulating substrate 32 can be constructed from a flexible polymer, foam, rubber or like material. A flexible adhesive strip 38 is provided wrapped around magnet-retaining member 32. Preferably, adhesive strip 38 is provided having adhesive on both of its major surfaces. The adhesive on the interior surface of strip 38 functions to maintain the positioning of the magnets within flexible member apertures 40, while the adhesive on the exterior surface of the strip functions to substantially restrict movement of the magnetic assembly 30 within the enclosure 20.

Preferably, the magnets 36 are provided pre-coated with a non-corrosive material, such as, for example, epoxy, paint, nickel or rubber to minimize corrosion. The applicants have found great success employing relatively small sized, highly magnetic ZETA6 brand magnets available from Illinois Glove Company of Northbrook, Ill. The magnets 36 are positioned in a spaced-apart relationship within flexible member 32. One function of employing the spaced-apart configuration is to substantially eliminate potential magnetic interference between adjacent magnets. Additionally, the spaced-apart configuration functions to enable and facilitate substantially unrestricted bending or flexing of member 32 in conformance with corresponding bending of the rear surface of a wearer's hand, for example, while closing the gloved hand during gripping of a tool or work piece.

Following extensive experimentation, the applicants have found that the incorporation of the flexible magnetic assembly 30, in conjunction with the incorporation of a corresponding flexible enclosure 20, contributes significantly to the comfort of the glove. Furthermore, the applicants have determined that an adequate magnetic field can be generated using only three of the aforementioned magnets 38 arranged in the vertically staggered arrangement illustrated in the accompanying drawing figures.

Referring now to FIGS. 4–7, various alternative configurations of magnetically insulating substrate 32 are provided.

Figure 4:
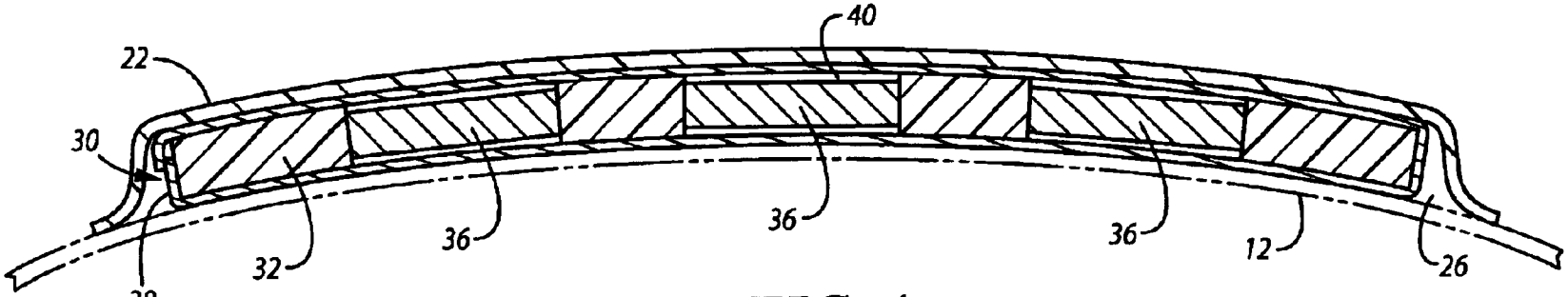

As best shown in FIG. 4, in one aspect of the invention, magnetic assembly 30 incorporates a unitary flexible substrate 32 having apertures 40 sized and shaped for having magnets 36 snugly received therein. As previously described, when employing this configuration, adhesive strip 38 is provided completely wrapped around the magnet-retaining flexible substrate 32.

Figure 5:
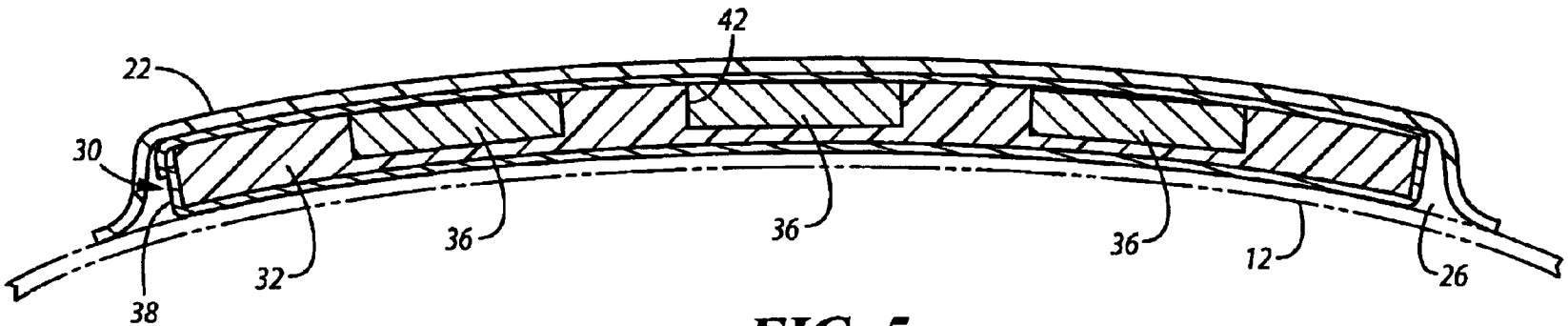

Referring specifically to FIG. 5, an alternate embodiment of flexible substrate 32 is provided having magnet-receiving cavities 42 in lieu of apertures 40. When employing this configuration, adhesive strip 38 can be provided covering only the cavity-containing surface of the substrate. However, it is preferred that a double sided adhesive strip 38 is provided completely wrapped around the substrate 32, as shown.

Figure 6:
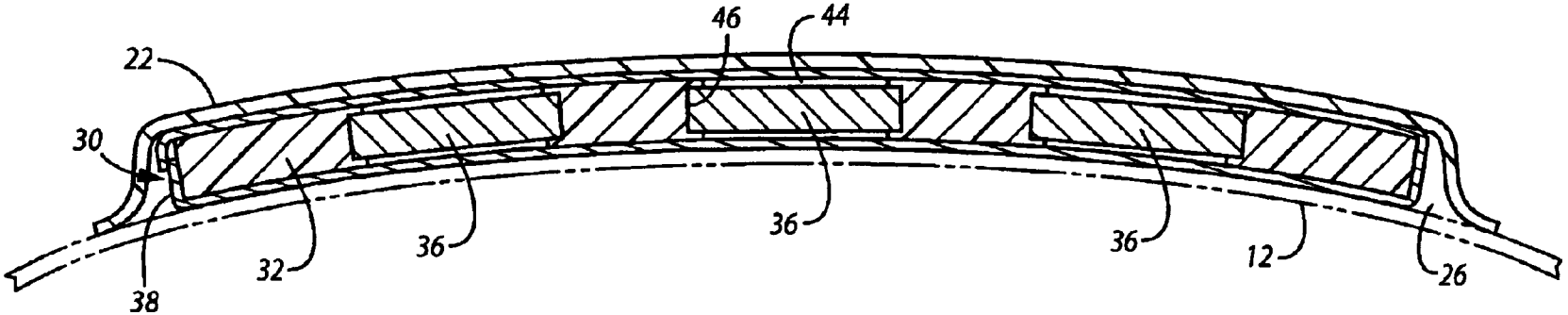

Referring now specifically to FIG. 6, a further embodiment of flexible substrate 32 incorporates apertures having a shape complementary to the perimeter of the magnets 36, but having a slightly reduced perimeter size vis-a-vis the magnet perimeter. A groove 46 provided recessed in the sidewall of each aperture 44 is sized and shaped to enable magnet 36 to be snap-fitted therein. The snap-fit arrangement functions to enable the magnets to be securely maintained within the apertures, without the aid of adhesive strip 38. However, it is preferred to employ adhesive strip 38 wrapped around substrate 32 to assist in preventing shifting of magnetic assembly 30 within the interior space 26 of enclosure 20.

Figure 7:
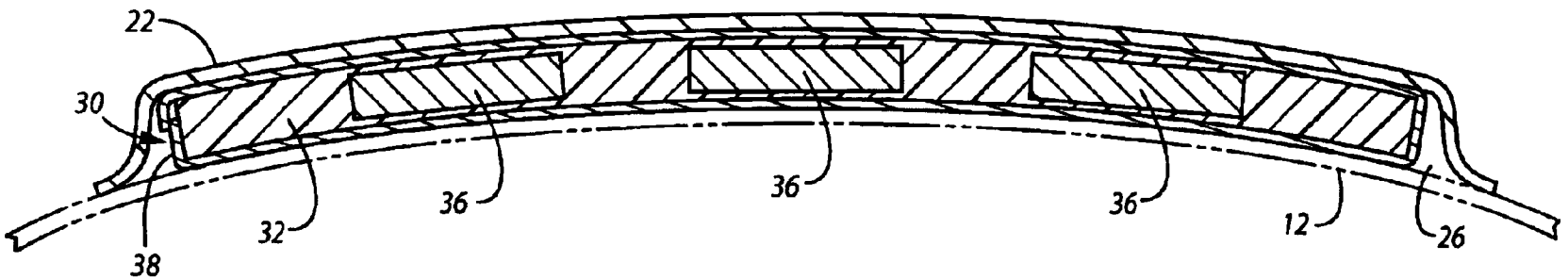

Referring now specifically to FIG. 7, in a further embodiment of the invention, the magnets 36 are provided completely encapsulated within flexible substrate 32. Again, although it is preferred to incorporate an adhesive wrap 38, adhesive coating, or the like about flexible substrate 32, as shown, such an arrangement is not necessary. Alternatively, it is contemplated to provide the magnets partially encapsulated within the flexible substrate 36, wherein an aperture extending through the substrate above each magnet provides for an improved magnetic field vis-à-vis the fully encapsulated magnets.

Figure 8:
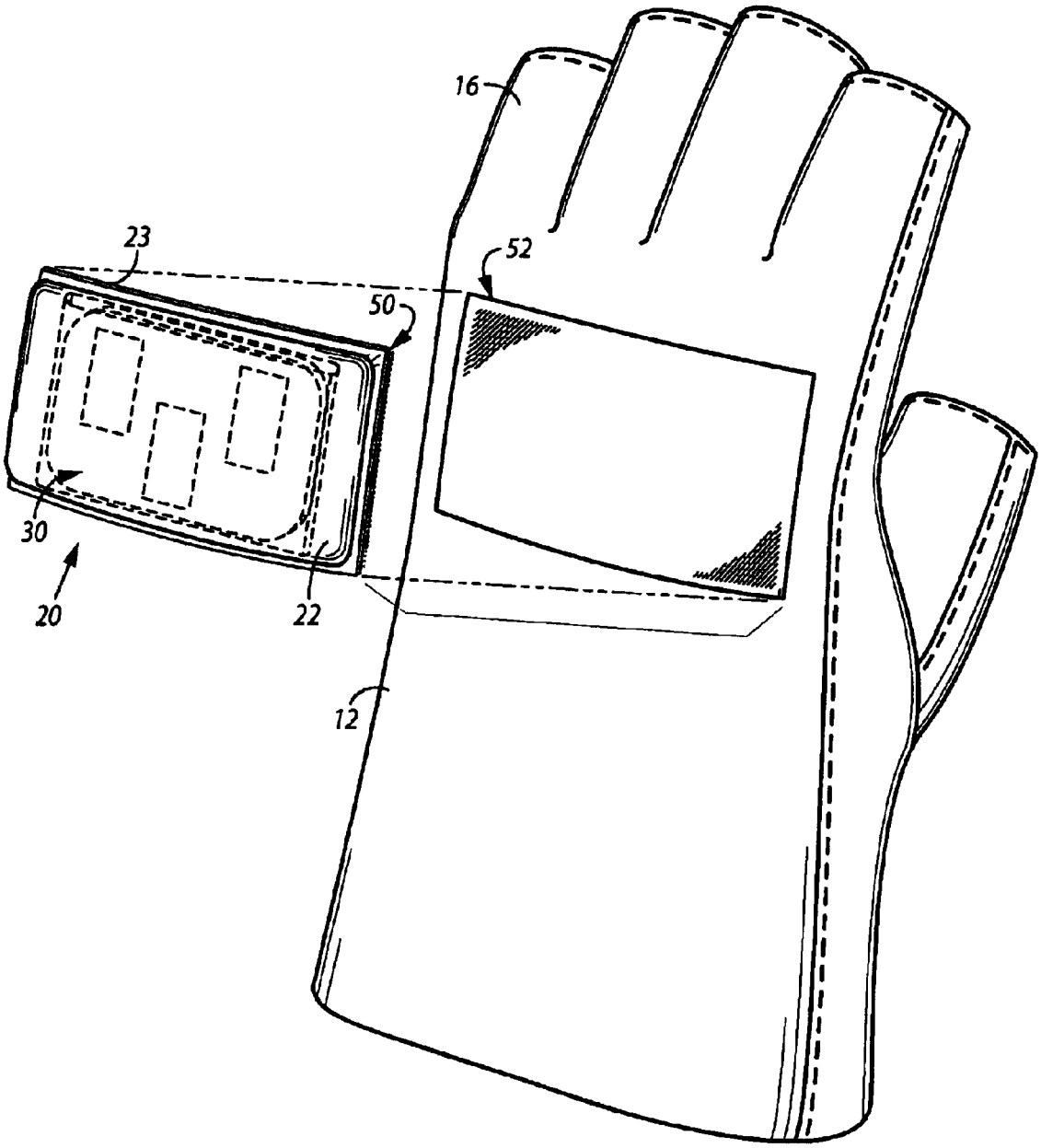
FIG. 8 is a perspective view of a further embodiment of the magnetized work glove of the present invention, wherein magnetic assembly 30 is maintained within a discrete enclosure 20, and a hook-and-loop type fastening system provides releasable attachment of the enclosure to the rear surface of the glove.
Figure 9:
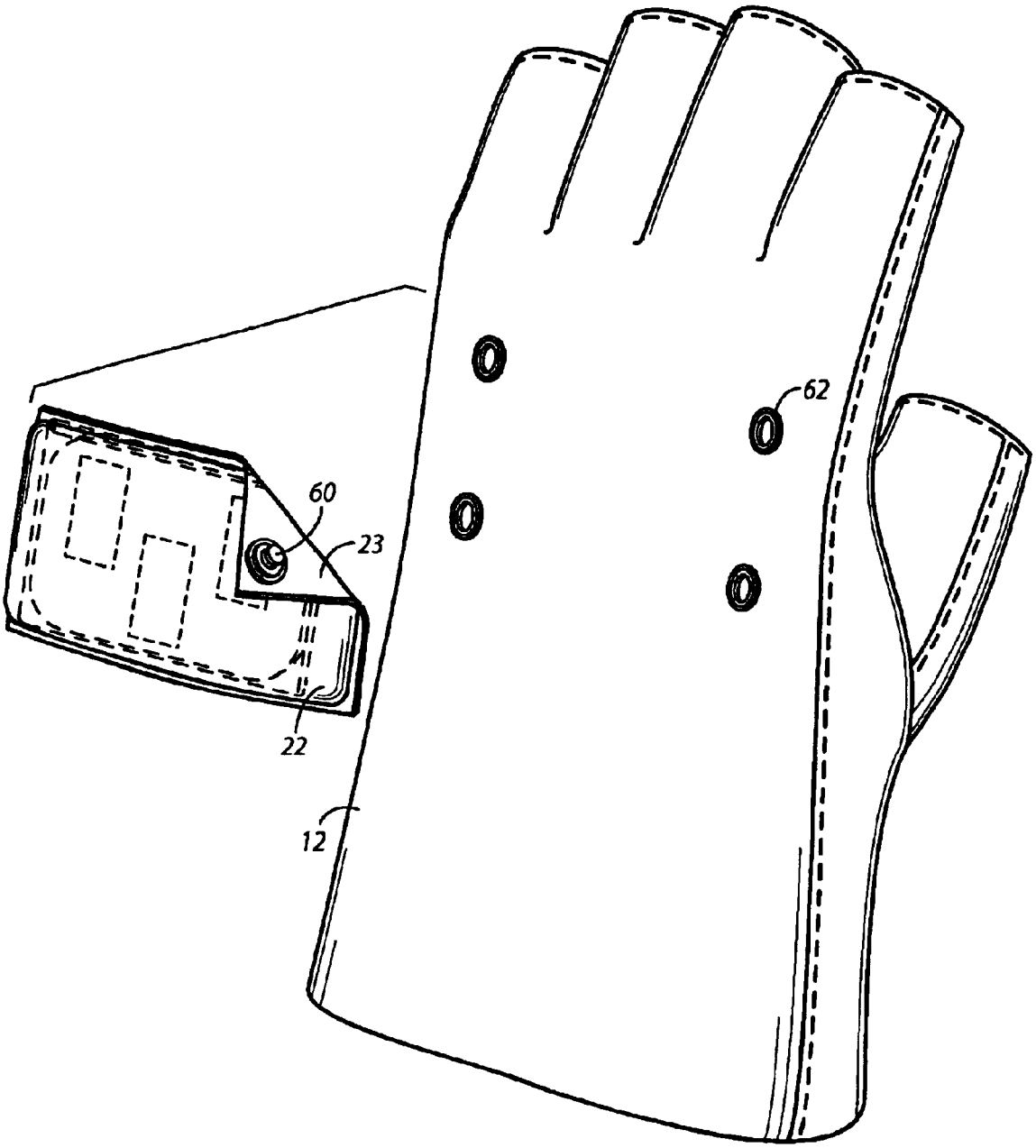
FIG. 9 is a perspective view illustrating the incorporation of a mechanical snap system 60, 62 for enabling releasable attachment of the discrete enclosure to the back surface of the glove, in accordance with a further embodiment of the present invention.

Referring now to FIGS. 8–9, in a further aspect of the present invention, magnetic enclosure 20 is constructed separate or apart from the back surface of the glove, and is configured for releasable attachment to the back surface 12 of glove 10. In this aspect of the invention, enclosure 20 is constructed by permanently attaching peripheral portions of upper and lower enclosure layers, 22 and 23, respectively, to each other using a chemical adhesive, stitching, or any other available means. Magnetic assembly 30 is provided within the completely enclosed interior space. As will be apparent to those skilled in the art, any of the aforementioned embodiments of magnetic assembly 30 can be incorporated into the present enclosure embodiment.

Referring now specifically to FIG. 8, the aforementioned releasable attachment can be achieved using a hook-and-loop type fastening system, such as those sold under the trademark VELCRO. In particular, a first half of the hook-and-loop system, shown generally as reference numeral 50, is permanently affixed to the exterior surface of lower layer 23. A second half of the hook-and-loop system, shown generally as reference numeral 52, is permanently affixed to the back surface 12 of glove 10. The first and second halves, 36 and 38, of the hook-and-loop system cooperate in a manner well known in the art to enable releasable attachment of magnet-retaining enclosure 20 to back surface 12 of glove 10.

Referring now specifically to FIG. 9, alternatively, releasable attachment can be achieved using a mechanical snap system, wherein mating mechanical snap members, 60 and 62, are provided disposed on the lower layer 23 of enclosure 20 and glove back surface 12, respectively.

Figure 10:
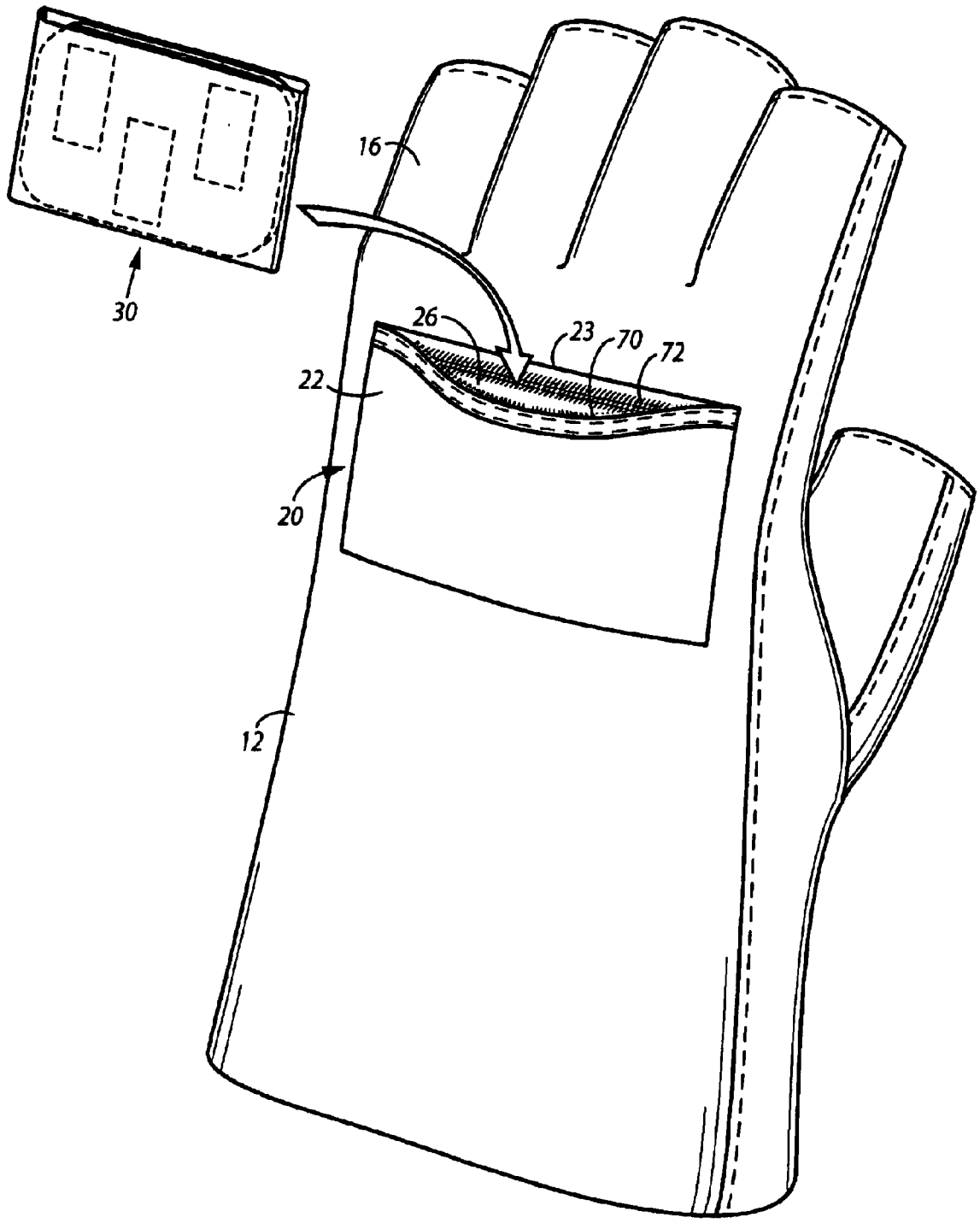
FIG. 10 is a perspective view of a further embodiment of the magnetized work glove of the present invention, wherein magnet assembly receiving enclosure 20 is provided having a hook-and-loop type fastening system along an edge thereof for enabling selective access to an enclosure interior space 26.
Figure 11:
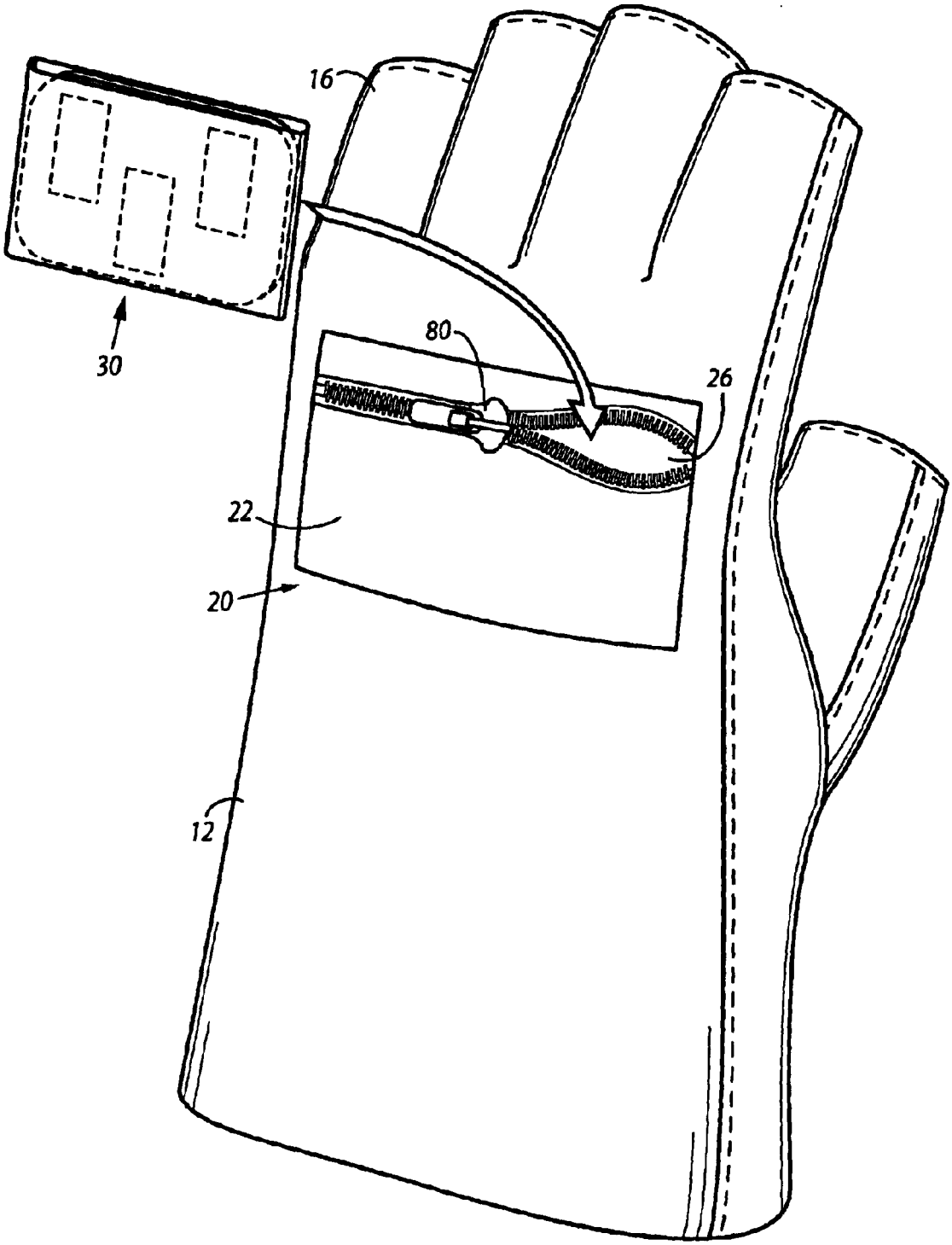
FIG. 11 illustrates the incorporation of an enclosure zipper system for enabling selective access to interior space 26.

Referring now to FIGS. 10–11, in a further aspect of the invention magnetic enclosure 20 is provided having means for selectively accessing interior space 26. In this manner, the interior space 26 of the enclosure can be accessed to insert, remove, reposition or otherwise manipulate magnetic assembly 30.

Referring now specifically to FIG. 10, in one embodiment of the invention, the aforementioned selective access is achieved using cooperating strips, 70 and 72, of hook-and-loop type fastener materials disposed partially along the periphery of the facing surfaces of respective upper and lower enclosure layers, 22 and 23.

Referring now specifically to FIG. 11, in another embodiment of this aspect of the invention, selective access is achieved using a conventional zipper system 80 incorporated into enclosure upper layer 22.

Figure 13:
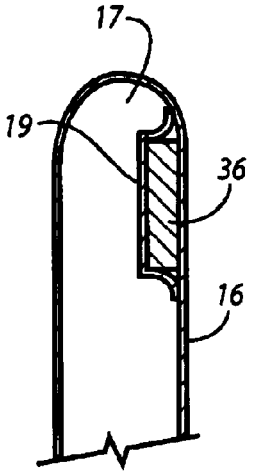
FIG. 13 is a cross-sectional view taken along cutting plane 13—13 in FIG. 12.
Figure 12:
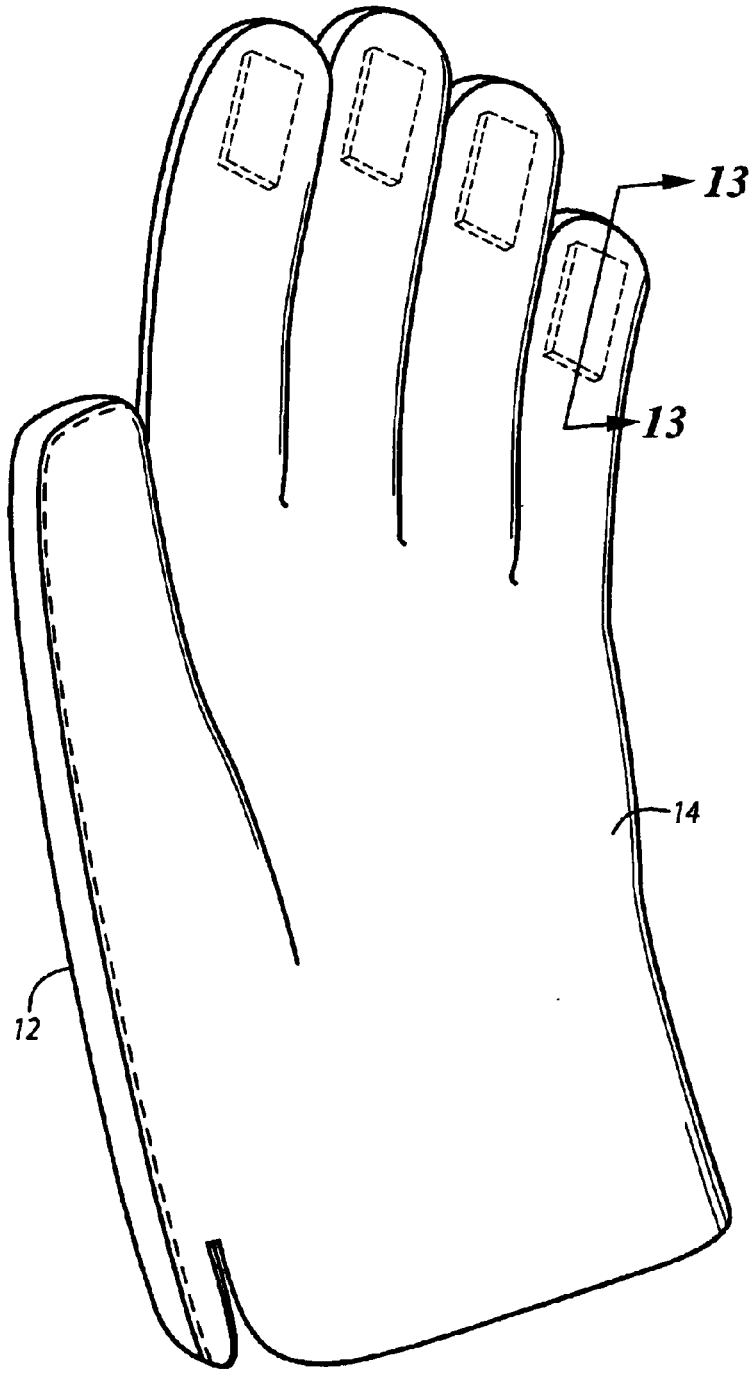
FIG. 12 is a perspective view of another aspect of the magnetized work glove of the present invention, wherein magnets are provided at the finger tip portions of the glove for facilitating gripping of components during a construction or assembly operation.

Referring now to FIGS. 12–13, in a further aspect of the invention incorporating completely enclosed glove finger portions 16, additional magnets 36 are provided disposed within the interior finger tip spaces 17 for maintaining ferrous containing components 18 against the finger tip portions of the glove during an operation. In this manner, the occurrence of dropped components during an operation is minimized since individual components are magnetically secured against the outer surface of the finger-receiving portions of the glove, even when the wearer loses his grip on a component. Preferably, the fingertip magnets 36 are maintained within an enclosure 19 formed by securing a covering article 19 to an interior surface of fingertip portion 16.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A work glove, comprising:

a glove body having a flexible back surface;

a flexible enclosure having upper and lower layers permanently attached about their peripheries to define a completely enclosed interior space;

a plurality of magnets disposed in spaced-apart relationship within the completely enclosed interior space of said flexible enclosure;

magnet-insulating means disposed within the completely enclosed interior space, said magnet-insulating means constructed and positioned to minimize magnetic interference between adjacent ones of said plurality of magnets and to prevent said plurality of magnets from sliding about within said enclosed interior space, with an exterior surface of an upper one of said two-layer enclosure providing a substantially planar magnetic surface for receiving and retaining metal components against said exterior surface; and means for releasably attaching said flexible enclosure to the flexible back surface of said glove body at a position adjacent to the knuckle portion of a user's hand when worn.

2. A work glove as recited in claim 1, wherein said means for releasable attachment further comprises:

one-half of a hook-and-loop fastener system disposed upon an exterior surface of the lower layer of said flexible enclosure; and a corresponding second half of said hook-and-loop fastener system disposed upon the flexible back surface of said glove body.

3. A work glove as recited in claim 1, wherein said means for releasable attachment further comprises:

a first set of mechanical snap members disposed upon an exterior surface of the lower layer of said flexible enclosure; and a second set of mechanically mating snap members disposed upon the flexible back surface of said glove body.

4. A work glove, comprising:

a glove body having a flexible back surface;

a flexible article of material having a periphery permanently attached to the flexible back surface of said glove body to define a completely enclosed interior space at a position adjacent the knuckle portion of a user's hand when worn;

a one-piece magnetically insulating flexible substrate having magnet-receiving portions provided in spaced-apart relationship therein;

a plurality of magnets positioned within the magnet-receiving portions of said flexible substrate; and a flexible adhesive strip wrapped completely around said magnet-containing flexible substrate to form a unitary magnetic assembly;

said unitary magnetic assembly fixedly positioned within said enclosed interior space, such that the exterior surface of flexible article of material provides a substantially planar magnetic surface for receiving and retaining metal components against said exterior surface.

5. A work glove as recited in claim 4, wherein the spaced-apart magnet-receiving portions of said one-piece magnetically-insulating flexible substrate further comprise apertures extending completely therethrough, the apertures having a size and shape complementary to the size and shape of said magnets.

6. A work glove as recited in claim 4, wherein the spaced-apart magnet-receiving portions further comprise cavities provided in an upper surface of said flexible substrate, the cavities having a size and shape complementary to the size and shape of said magnets.

7. A work glove as recited in claim 4, wherein the spaced apart magnet-receiving portions further comprise apertures extending completely through said flexible substrate, the apertures having a shape complementary to the shape of said magnets but sized slightly smaller than said magnets, each aperture sidewall having a continuous groove configured for snap-fitting engagement with the perimeter of a single one of said magnets.

8. A work glove as recited in claim 4, wherein said magnets are at least partially encapsulated within said magnetically insulating flexible substrate.

9. A work glove as recited in claim 4, wherein the spaced-apart magnet-receiving portions of said one-piece magnetically-insulating flexible substrate are vertically staggered.

* * * * *